US012584362B2

(12) United States Patent
Saraya et al.

(10) Patent No.: US 12,584,362 B2
(45) Date of Patent: Mar. 24, 2026

(54) METHODS AND SYSTEMS FOR A FRAC PLUG

(71) Applicant: Vertice Oil Tools Inc., Missouri City, TX (US)

(72) Inventors: Mohamed Saraya, Sugar Land, TX (US); Stephen Parks, Houston, TX (US); Mike Lo, Houston, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 19/089,446

(22) Filed: Mar. 25, 2025

(65) Prior Publication Data

US 2025/0223881 A1 Jul. 10, 2025

Related U.S. Application Data

(63) Continuation of application No. PCT/US2023/036349, filed on Oct. 31, 2023.

(60) Provisional application No. 63/436,163, filed on Dec. 30, 2022.

(51) Int. Cl.
*E21B 23/00* (2006.01)
*E21B 33/12* (2006.01)

(52) U.S. Cl.
CPC ..... *E21B 23/00* (2013.01); *E21B 33/12* (2013.01)

(58) Field of Classification Search
CPC ..... E21B 23/00; E21B 33/12; E21B 33/1293; E21B 33/134; E21B 23/06
See application file for complete search history.

(56) References Cited

U.S. PATENT DOCUMENTS

| | | | | | |
|---|---|---|---|---|---|
| 4,180,132 | A * | 12/1979 | Young | E21B 23/06 | 166/120 |
| 4,363,358 | A * | 12/1982 | Ellis | E21B 23/042 | 166/212 |
| 4,372,393 | A * | 2/1983 | Baker | E21B 33/129 | 166/138 |
| 4,540,048 | A * | 9/1985 | Gazda | E21B 23/02 | 166/217 |
| 4,756,363 | A * | 7/1988 | Lanmon, II | E21B 43/116 | 175/4.56 |
| 5,492,173 | A * | 2/1996 | Kilgore | E21B 33/1293 | 166/66.4 |
| 5,857,524 | A * | 1/1999 | Harris | E21B 43/10 | 166/216 |
| 9,157,288 | B2 * | 10/2015 | Martinez | E21B 23/01 | |
| 9,822,596 | B2 * | 11/2017 | Clemens | E21B 23/04 | |
| 11,555,377 | B2 * | 1/2023 | Lo | E21B 33/12 | |
| 11,661,814 | B1 * | 5/2023 | Saraya | E21B 33/128 | 166/387 |
| 11,851,975 | B1 * | 12/2023 | Saraya | E21B 33/128 | |
| 12,180,803 | B2 * | 12/2024 | Saraya | E21B 23/01 | |
| 12,305,477 | B2 * | 5/2025 | Lo | E21B 33/134 | |
| 2003/0111236 | A1 * | 6/2003 | Serafin | E21B 33/1243 | 166/387 |
| 2004/0069496 | A1 * | 4/2004 | Hosie | E21B 23/0411 | 166/373 |

(Continued)

*Primary Examiner* — Steven A MacDonald
(74) *Attorney, Agent, or Firm* — Pierson IP, PLLC

(57) ABSTRACT

An adaptor kit is configured to limit the amount of shear pins/metal/material left downhole after the frac plug is set and the setting tool is removed from the hole. More specifically, embodiments may utilize a setting sleeve that is configured to set the frac plug.

18 Claims, 14 Drawing Sheets

(56) References Cited

U.S. PATENT DOCUMENTS

| | | | | |
|---|---|---|---|---|
| 2006/0219413 | A1* | 10/2006 | Vilela | E21B 17/07 166/242.7 |
| 2006/0272828 | A1* | 12/2006 | Manson | E21B 33/129 166/138 |
| 2008/0210063 | A1* | 9/2008 | Slack | E21B 19/06 81/420 |
| 2014/0054048 | A1* | 2/2014 | Schneidmiller | E21B 33/12 166/387 |
| 2015/0247368 | A1* | 9/2015 | Clemens | E21B 23/00 166/243 |
| 2016/0273290 | A1* | 9/2016 | Harms | E21B 17/046 |
| 2016/0305215 | A1* | 10/2016 | Harris | E21B 33/1291 |
| 2018/0135380 | A1* | 5/2018 | Saulou | E21B 33/128 |
| 2018/0363395 | A1* | 12/2018 | Silva | E21B 23/06 |
| 2020/0157915 | A1* | 5/2020 | Hern | E21B 23/01 |
| 2022/0259962 | A1* | 8/2022 | Lo | E21B 34/08 |
| 2023/0250704 | A1* | 8/2023 | Lo | E21B 33/134 166/124 |
| 2024/0003218 | A1* | 1/2024 | Saraya | E21B 43/26 |
| 2024/0093569 | A1* | 3/2024 | Saraya | E21B 33/129 |
| 2025/0198252 | A1* | 6/2025 | Saraya | E21B 33/134 |
| 2025/0215762 | A1* | 7/2025 | Lo | E21B 33/1208 |
| 2025/0223881 | A1* | 7/2025 | Saraya | E21B 33/12 |

* cited by examiner

METHODS AND SYSTEMS FOR A FRAC PLUG

BACKGROUND INFORMATION

Field of the Disclosure

Examples of the present disclosure relate to a downhole tool. More specifically, embodiments are related to a frac plug with lower slips and a lower cone. In embodiments, a lower cone ramp angle may be greater than or equal to a cone bevel angle and a slip inner cut angle. This geometry enables the fins of the cone to not interact with the lower slips, which may not shear the lower slips as the lower slips move over the cone. Instead, the lower slips may break due to stresses caused by the tendency of the lower slips to expand as the lower slips interact with the ramp of the lower cone. Further, the frac plug is run and set on an adapter kit that is connected to the frac plug via a collapsible collet which eliminates the need to have to shear pins left in the well.

Background

Conventionally, after cementing a well and to achieve Frac/zonal isolation for a Frac operation, a frac plug and perforations on a wireline are pushed downhole to a desired depth. Then, a frac plug is set and perforation guns are fired above to create conduit to frac fluid. This enables the fracing fluid to be pumped. Typically, to aid in allowing the assembly of perforation and frac plug to reach the desired depth, specifically in horizontal or deviated laterals, pumping operation can be used. During the pumping operation, the wireline is pumped down the hole with the aid of flowing fluid.

These conventional frac plugs are set via wire line adapter kits (WLAK) and are held in place via slips and packing elements. Conventional methods require the WLAK to be connected to the frac plug via shear pins. These pins are inserted inside the top section of the frac plug, and when sheared a portion of the shear pins remain in the plug, which are required to be milled later Accordingly, needs exist for systems and methods utilizing a frac plug with a WLAK that is connected to the Frac plug using methods that don't leave any shear pins behind, eliminating the need to mill out the shear pins after shearing.

SUMMARY

Embodiments may also be directed towards adapter kits used for setting the frac plugs, wherein the adaptor kits are configured to limit the amount of shear pins/metal/material left downhole after the frac plug is set and the setting tool is removed from the hole. More specifically, embodiments may utilize a setting sleeve that is configured to set the frac plug, wherein an adaptor kit is coupled to the frac plug without shear pins.

Embodiments may include a frac plug and setting tool. The setting tool may include the setting sleeve, setting rod, and adaptor kit.

The frac plug may be a conventional frac plug that is configured to be set responsive to a setting sleeve moving in a first direction to set the frac plug. After the frac plug is set, slips associated with the frac plug may radially expand across an annulus to grip an inner diameter of the casing.

The setting sleeve may be configured to move in the first direction to directly apply mechanical forces against the frac plug to set the frac plug by radially expanding the slips. The setting sleeve may move in the first direction while a mandrel of the frac plug and the setting rod stay relatively fixed in place along a longitudinal axis of the downhole tool.

The setting rod may be configured to have a stroke length that allows the setting sleeve to move in the first direction while the setting rod remains substantially fixed in place. However, when the setting rod is pulled in a second direction a distance longer than the stroke length, to be removed from the hole, the setting rod and the setting sleeve may travel together. The setting rod may have a distal end that is coupled to an adaptor element of the adaptor kit.

The adapter element of the adaptor kit may be configured to selectively couple the setting rod to the frac plug mandrel without using shear pins or other materials that are left downhole. Specifically, an inner diameter of a collet may be propped open by a support sleeve when run in a hole, causing the no-go profile/threads on the outer diameter of the collet to interface with the no-go profile/threads on the inner diameter of the mandrel.

In embodiments, forces moving the setting rod in the second direction may shear the temporary coupling mechanisms that couple the adaptor element and the collet together, which may allow the relative movement of the support sleeve and the collet. Responsive to moving the support sleeve in the second direction while the collet remains fixed in place along the longitudinal axis of the downhole tool, the inner diameter of the collet may no longer be propped open by the support sleeve.

This relative movement of the support sleeve and collet may cause the distal end of the collet to collapse. The collapsing of the distal end of the collet may give clearance between the outer diameter of the collet and the inner diameter of the mandrel, allowing the adaptor kit, collet, and support sleeve to be pulled out of the hole.

Furthermore, when the support sleeve moves in the second direction relative to the fixed collet, a profile on the outer diameter of the support sleeve may be positioned within a cavity on the inner diameter of a stem of the collet. When the profile on the outer diameter of the support sleeve is aligned with the cavity of the collet, when the setting sleeve is moved in the second direction, the profile on the outer diameter of the support sleeve may transfer forces against the collet. This may cause the collet to correspondingly move with the support sleeve.

To this end, the adaptor kit may enable a setting tool to be temporarily coupled to the mandrel of the frac plug via threads and not shear pins. This may limit the amount of shear pins/metal/material or elements left downhole relative to conventional frac plugs Embodiments may also be directed towards systems and methods for a frac plug. The frac plug may include a lower cone and a lower slip. The frac plug may also include other elements that may be sequentially loaded on a mandrel of the frac plug. For example, the frac plug may also include a load ring, upper slips, upper cone, and a packer.

The lower slips may be positioned adjacent to the lower cone and the cap. The lower slips may be a component that is used to grip and hold the frac plug against the casing's internal diameter. The lower slips may be configured to radially expand or break based on the relative movement with the lower cone. The lower slips may include a plurality of wedges that are formed in a near circle around the mandrel. After the lower slips are deployed and radially expanded, pairs of the wedges may be retained together. In embodiments, the lower slips may include an inner surface and webbing. The inner surface may have a first angle, and be configured to interface with a ramp of the lower cone. Responsive to the inner surface of the wedges interfacing with the ramp, the lower slip may radially expand.

The webbing may have an inner surface that has a slip inner cut angle that is substantially the same as the first angle of the ramp of the lower cone and a cone bevel angle of a fin. In embodiments, due to the relative geometries of the inner surface of the webbing and the cone bevel angle of the fin, the inner surface of the webbing may not touch, intersect, or contact an outer surface of the fin. By eliminating the contact between the webbing and the fins, a failure point of the lower slip may be removed. Furthermore, the slip inner cut angle may increase the thickness of the webbing at a location that is further away from the distal end of the fin, which may also decrease the likelihood of wedges of the slips breaking apart from each other.

The cone may be positioned between the packing element and the lower slips. The cone may be configured to slide towards the cap of the frac plug to radially expand the lower slips. The cone may include a ramp and fins. The ramp may be configured to interface with the inner surface of the wedges to radially expand the lower slips. The ramp may have a lower cone ramp angle that can be any realistic angle for a lower cone, such as between 5 and 30 degrees. In embodiments, the first angle may be substantially the same as the lower cone ramp angle, which may assist in radially expanding the lower slips.

The fins may be configured to be positioned within the upper notches of the webbing when run in a hole, and under the webbing of the lower slips when the lower slips are activated. The fins may have a cone bevel angle that may be substantially equal to or less than the lower cone ramp angle, wherein the cone bevel angle is equal to that of the slip inner cut angle. However, in other embodiments, the cone bevel angle may be slightly greater than the lower cone ramp angle. For example, the cone bevel angle may be ten degrees larger than the lower cone ramp angle. In embodiments, the outer surface of the fins and the inner surface of the webbing may be offset from each other when run in a hole, and both are positioned away from the outer diameter of the mandrel. Due to the equal angling of the outer surface of the fins and the inner surface of the webbing, the two may not contact each other even after the cone moves toward the cap and the lower slips are activated. This may enable the wedges of the lower slips to not break due to the fins interacting with the webbing. However, the wedges may break due to hoop stresses caused by the wedges expanding as they move over the ramp of the cone.

Furthermore, in embodiments, even if the outer surface of the fin was to interact with the lower surface of the webbing, a fin would not initially contact an edge of the webbing. This would merely assist in radially expanding the webbing rather than shearing the webbing.

The cap may be positioned on a distal end of the frac plug. The cap includes a passageway, recess, and projection. The passageway may be an opening extending through the inner diameter of the cap from a proximal end to a distal end of the cap, which allows fluid to flow through the inner diameter of the frac plug. The recess may be a groove, depression, etc. positioned on the distal end of the cap, wherein the recess is cylindrical. The projection may extend away from the lip in a direction along the longitudinal axis of the frac plug. The projection may have an inner diameter that is greater than that of the passageway and smaller than the outer diameter of the recess. The projection may be configured to receive a frac ball, object, etc., such that if the frac ball is positioned on the projection there is communication through the passageway via the space between the frac ball and the recess.

In embodiments, the cap and the lower slips may form an anti-rotation mechanism. The anti-rotation mechanism may be configured to allow relative linear movement between the cap and the lower slips but restrict relative rotational movement between the cap and the groove. The anti-rotation mechanism may include projections positioned on the distal end of the lower slips and grooves positioned on the proximal end of the cap. In alternative embodiments, the projections may be positioned on the proximal end of the cap, and the grooves may be positioned on the distal end of the lower slips.

Embodiments may include a flapper with a weak point, wherein the flapper is configured to rotate from a position blocking an inner diameter of the frac plug to a position allowing fluid to flow around the flapper. The flapper may be mounted inside the mandrel of the frac plug. The flapper may include a removable weak point assembly that is configured to form a passageway responsive to removing the removable weak point assembly, wherein the weak point assembly extends from the upper surface of the flapper to the lower surface of the flapper. In embodiments, the flapper may be positioned closer to the proximal end of the frac plug than the load ring. By positioning the flapper above the elements of the frac plug, the flapper may restrict the flow of fluid through the mandrel, which may limit the pre-mature setting of the frac plug.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
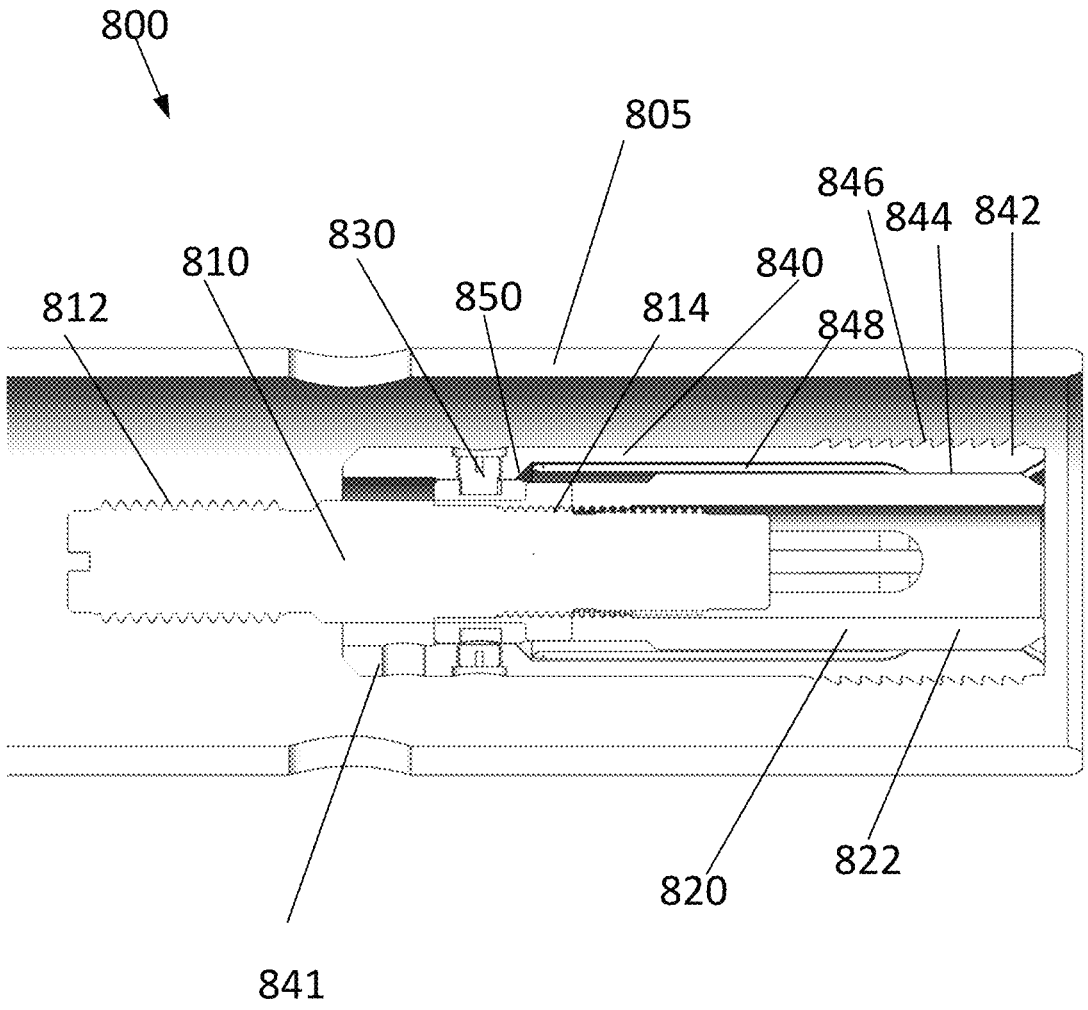
FIG. 1 depicts a system utilizing an adaptor kit to couple a setting tool with a frac plug, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a system 800 utilizing a wireline adaptor kit to couple a setting tool with a frac plug or any other conveyed object with a mandrel, according to an embodiment. System 800 may be configured to position a frac plug and setting tool downhole without directly coupling the frac plug and setting sleeve together via shear screws, shear pins, etc. Specifically, system 800 is directly towards wire line adapter kits that are utilized to set frac plugs without shear pins. This may allow system 800 to minimize or null the amount of material that needs to be milled out of the hole at a later point. System 800 may also allow the setting tool to set the frac plug, and be pulled out of the hole directly after setting the frac plug by moving the setting tool in a continuous up-hole direction after the frac plug is set and after the adapter kit is disconnected from the frac plug.

System 800 may include a setting sleeve 805, adaptor element 810, support sleeve 820, temporary coupling mechanisms 830, and collet 840.

Setting sleeve 805 may be a sleeve that is configured to move in the first direction to set the frac plug. Based on a stroke distance between the setting rod and the setting sleeve 805 movement of the setting sleeve 805 in the first direction may not cause movement of the setting rod in the first direction, or correspondingly the adaptor element 810.

The adaptor element 810 may be configured to couple the setting rod and support sleeve 820 together without a shear pin, shear screws, or other breakable elements. A first end of the adaptor element 810 may include first threads 812 that are configured to interface with threads on an inner diameter of the setting rod 920. A second end of adaptor element 810 may include second threads 814 that are configured to interface with corresponding threads on an inner diameter of support sleeve 820. In other cases, adapter element 810 and support sleeve 820 can be one piece formed of a unitary piece of material.

The support sleeve 820 may be configured to be coupled to the adaptor element 810 via threads/other methods 814, and extend along and within a central axis of collet 840 to prop open a distal end 842 of collet 840. Support sleeve 820 may have a profile 822 on an outer diameter of support sleeve 820 that is configured to increase the outer diameter of support sleeve 820. Profile 822 may be configured to maintain distal end 842 of collet 840 in the open position until support sleeve 820 is moved in the second direction relative to a fixed collet 840. Responsive to support sleeve 820 moving in the second direction while collet 840 remains fixed, profile 822 may be configured to be misaligned with distal end 842 of collet 840 and be positioned within cavity 848. When profile 822 is positioned within cavity 848, profile 822 may no longer prop open distal end 842 of collet 840, which may allow distal end 842 of collet 840 to radially collapse. Furthermore, when profile 822 is positioned within cavity 848 and support sleeve 820 moves in the second direction, profile 822 may translate forces against ledge 850 to correspondingly move collet 840 in the second direction. To this end, when traveling in the second direction, collet 840 may encompass support sleeve 820.

Temporary coupling mechanisms 830 may be shear screws, pins, threads, etc. that are configured to selectively couple adaptor element 810 and collet 840 together at a first location. Responsive to applying forces that are greater than a force threshold to move adaptor element 810 in a first direction, temporary coupling mechanisms 830 may shear. The shearing or breaking of temporary coupling mechanisms 830 may allow the relative movement of adaptor element 810 and support sleeve 820 with collet 830. However, before the shearing or breaking of temporary coupling mechanisms 830, the adaptor element and support sleeve 820 may not move relative to collet 840. Furthermore, when adaptor elements 820 and collet 830 are pulled out of the hole, the broken portions of temporary coupling mechanisms 830 may also be pulled out of the hole. This may minimize the amount of material/metal positioned downhole after setting the frac plugs. In other cases, temporary coupling mechanism 830 may be formed of dissolvable material and may be any type of temporary coupling mechanism.

Collet 840 may be a sleeve with a segmented distal end 842 that is configured to collapse to reduce the size of its inner diameter. Collet 840 may have a proximal end 841 with a fixed inner diameter that is configured to be coupled with adaptor element 810 via temporary coupling mechanisms 830. Distal end 842 of collet 840 may be configured to automatically collapse to reduce an inner diameter across distal end 842 when no object is propping open distal end 842. Distal end 842 may have a projection 844 that is configured to increase the thickness of distal end 842 of collet 840 and to decrease the length of the inner diameter cross distal end 842 of collet 840. In embodiments, projection 844 is configured to be positioned directly adjacent to profile 822 of support sleeve 820 when temporary coupling mechanisms 830 are intact. Specifically, profile 822 may be configured to be positioned adjacent to projection 844 to prop open distal end 842, which may not allow distal end 842 to collapse.

Distal end 842 may also include a threaded outer profile 846. Threaded outer profile 846 may be configured to couple collet 840 and the mandrel of the frac plug together when support sleeve 820 is propping distal end 842 open. However, when support sleeve 830 is not propping distal end 842 open, distal end 842 may collapse and the diameter across distal end 842 may decrease, which may decouple collet 840 from the mandrel. In further embodiments, distal end 842 of collet 840 may be coupled to corresponding threads on any conveyed object, such as a frac plug. However, collet 840 and system 800 may be configured to convey any object downhole.

Between projection 844 and a proximal end 841 may be a cavity 848. Cavity 848 may be configured to receive profile 822 on support sleeve 820 responsive to support sleeve 820 moving in a second direction relative to a static collet 840. When profile 822 is positioned within cavity 848 and adaptor element 810 moves support sleeve 820 in the second direction, profile 822 may apply forces against ledge 850 to correspondingly move collet 840 in the second direction. Furthermore, when profile 822 is positioned within cavity 848, distal end 842 may have a smaller inner diameter than the outer diameter of support sleeve 820. This may effectively lock profile 822 within the cavity 848.

Figure 2:
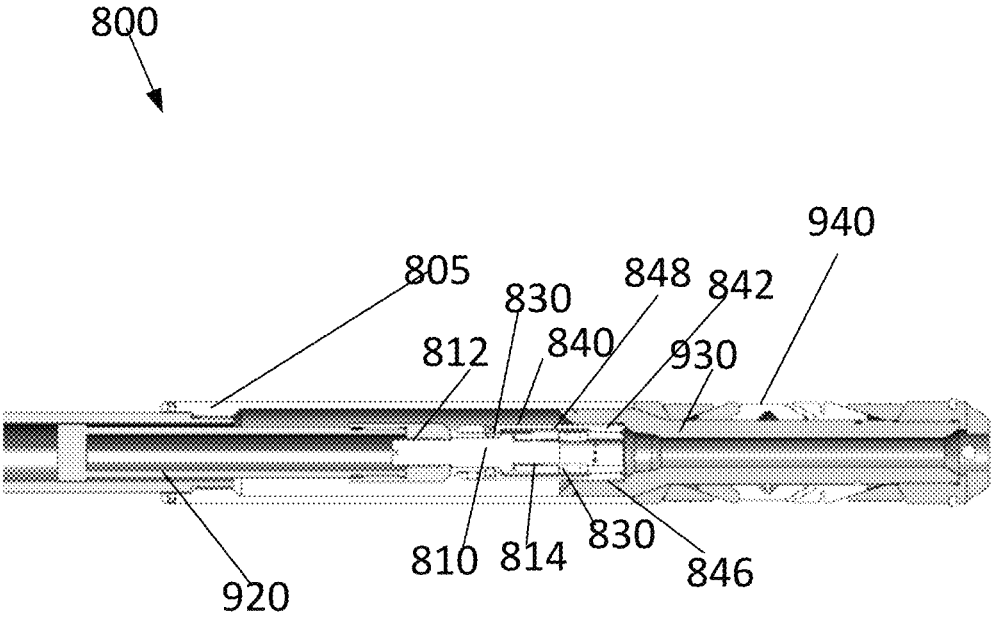
FIG. 2 depicts a system utilizing an adaptor kit to couple a setting tool with a frac plug when run in a hole, according to an embodiment.

FIG. 2 depicts a system 800 utilizing an adaptor kit to couple a setting tool with a frac plug 940 when run in a hole, according to an embodiment. Elements depicted in FIG. 2 may be described above, and for the sake of brevity, a further description of these elements is omitted.

As depicted in FIG. 2, setting sleeve 805 may be positioned adjacent to frac plug 940. This may allow setting sleeve 805 to apply forces against frac plug 940 to radially expand the slips of frac plug 940. Further, when run in a hole, mandrel 930 of frac plug 940 may be coupled to collet 840 via threads on the outer diameter of collet 840. These threads may couple collet 840 and mandrel 930 as long as support sleeve 830 props open distal end 842, wherein the propping open of distal end 842 may cause the threads on the outer diameter of collet 840 to be embedded within the threads on the inner diameter of mandrel 930. In embodiments, mandrel 930 may be associated with frac plug 940 or any other type of object.

Figure 9:
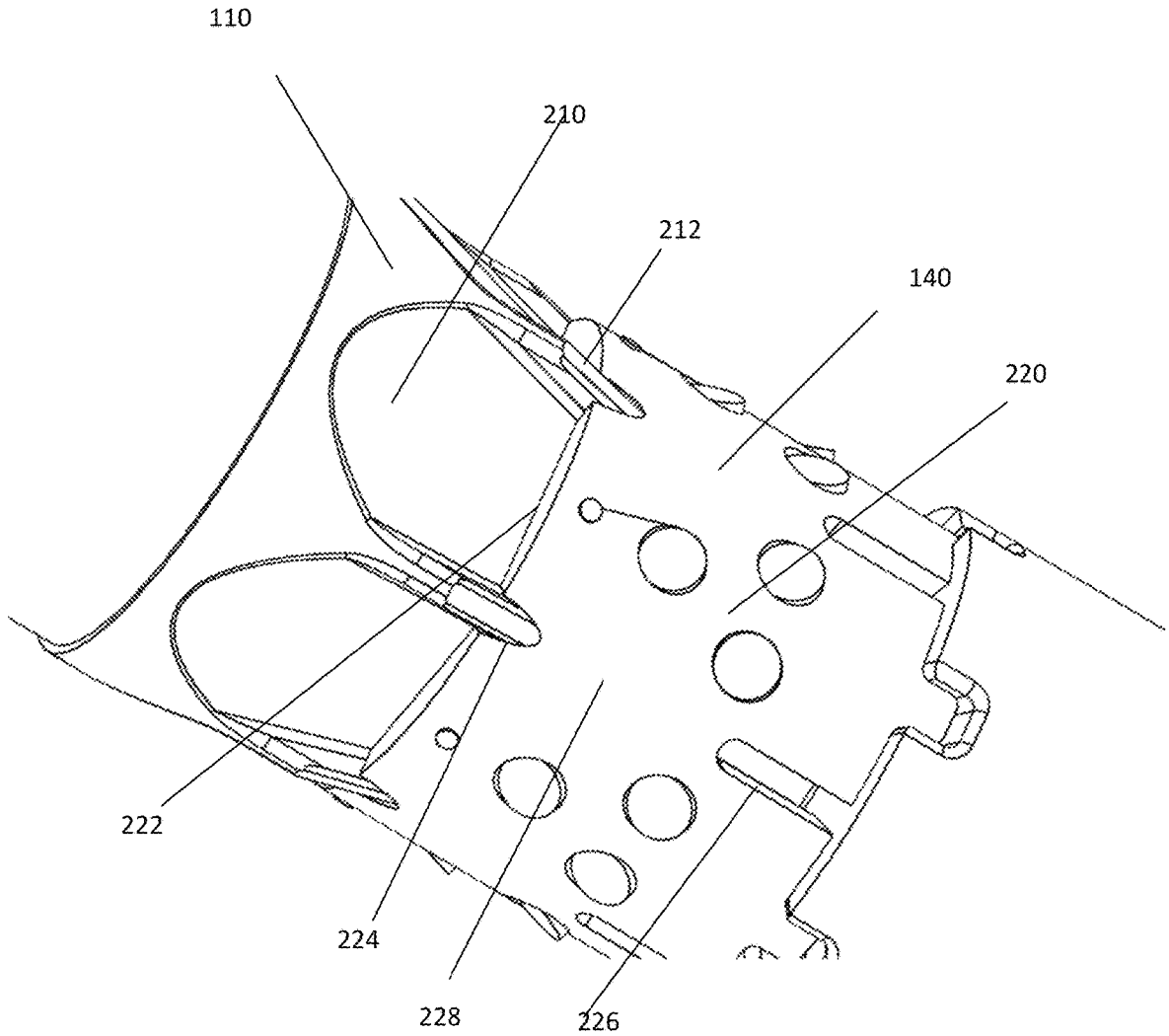
FIG. 9 depicts a perspective view of the lower cone and lower slips, according to an embodiment.

As also depicted in FIG. 9, setting rod 920 may be configured to be coupled to adaptor element 810 via threads 812. This coupling may allow for setting rod 920 to correspondingly move adaptor element 810.

Figure 3:
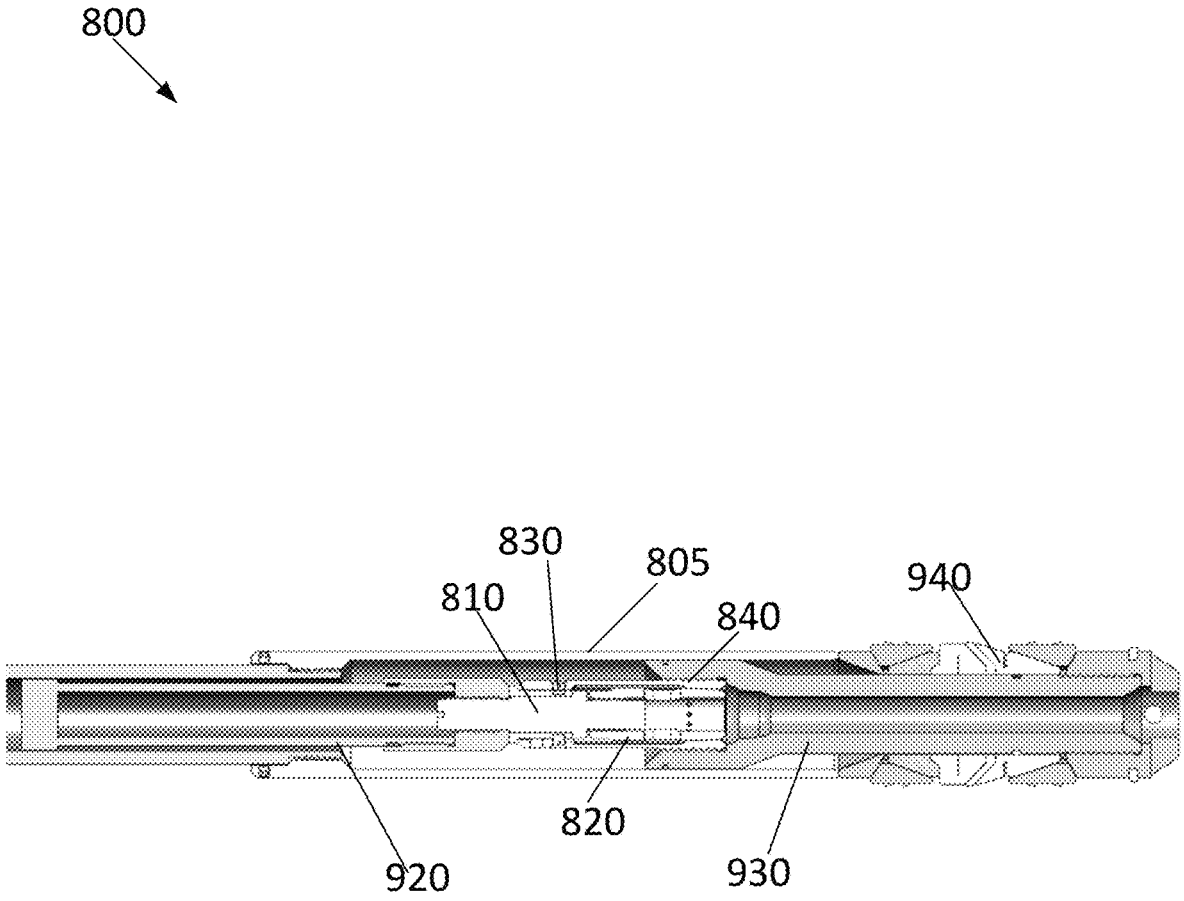
FIG. 3 depicts a system utilizing an adaptor kit to couple a setting tool with a frac plug when the frac plug is set, according to an embodiment.

FIG. 3 depicts a system 800 utilizing an adaptor kit to couple a setting tool with a frac plug 940 when frac plug 940 is set, according to an embodiment. Elements depicted in FIG. 3 may be described above, and for the sake of brevity, a further description of these elements is omitted.

As depicted in FIG. 3, setting sleeve 805 is configured to move in a first direction and apply forces against frac plug 940. These forces may cause the slips of frac plug 940 to extend across an annulus and grip casing.

When setting sleeve 805 is moving in the first direction, setting rod 920 positioned entirely within setting sleeve 805 may not move. This may be due to the stroke length to set frac plug 940 via setting sleeve 805 being less than the distance between setting sleeve 805 and setting rod 920. This may also cause adaptor element 810, support sleeve 820, collet 840, and mandrel 930 to also be relatively fixed in place along a longitudinal axis of the casing. Furthermore, because support sleeve 820 and collet 840 remain fixed in place, temporary coupling mechanisms 930 may not shear when setting sleeve 805 moves downhole to set frac plug 940. Additionally, because there is no relative movement between support sleeve 820 and collet 840, support sleeve 820 may continue to prop open collet 840 after frac plug 940 is set.

Figure 4:
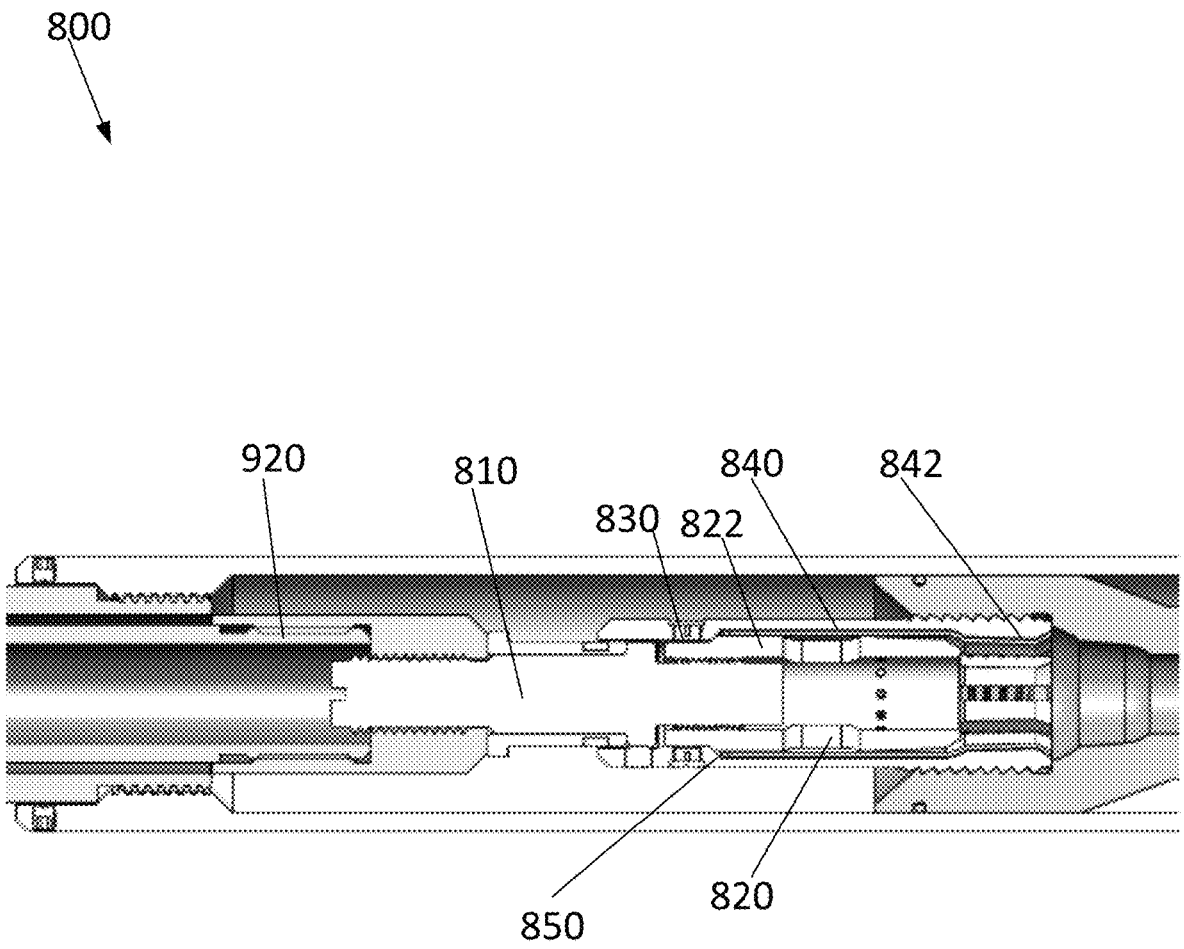
FIG. 4 depicts a system utilizing an adaptor kit to couple a setting tool with a frac plug after a setting rod is moved up the hole, according to an embodiment.

FIG. 4 depicts a system 800 utilizing an adaptor kit to couple a setting tool with a frac plug after setting rod 920 is moved up the hole, according to an embodiment. Elements depicted in FIG. 4 may be described above, and for the sake of brevity, a further description of these elements is omitted.

As depicted in FIG. 4, forces moving setting rod 920 in a second direction, which may be up the hole, may cause temporary coupling mechanisms 830 to activate, shear, break, etc. This breaking of temporary coupling mechanism 830 happens after frac plug 940 slips engages the casing and prevents the longitudinal movement of the frac plug 940, wherein the direction to activate temporary coupling mechanisms 830 may be an opposite direction that setting sleeve 805 moves to set frac plug 940.

Specifically, the uphole movement of setting rod 920 after activating coupling mechanisms 830 may allow support sleeve 820 to correspondingly move up the hole. Support sleeve 820 may move up the hole relative to collet 840 until a proximal end of profile 822 is positioned directly adjacent to ledge 850 of collet 840. This may cause support sleeve 820 to no longer be aligned with, and prop open, distal end 842 of collet 840, which may allow a diameter across distal end 842 to return to its normal smaller length.

Figure 5:
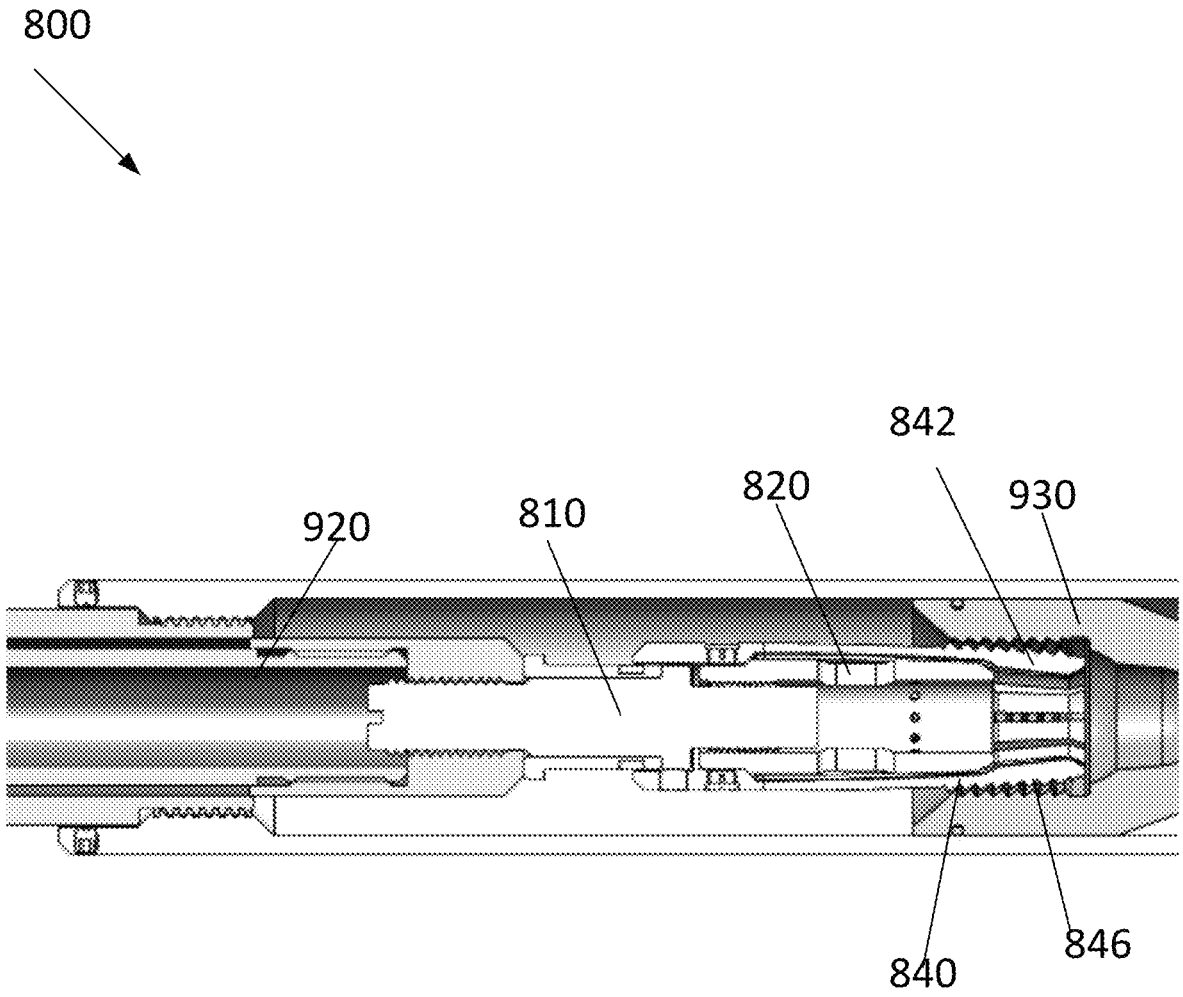
FIG. 5 depicts a system utilizing an adaptor kit to couple a setting tool with a frac plug after a support sleeve is no longer aligned with a distal end of a collet, according to an embodiment.

FIG. 5 depicts a system 800 utilizing an adaptor kit to couple a setting tool with a frac plug after a support sleeve is no longer aligned with a distal end 842 of a collet 840, according to an embodiment. Elements depicted in FIG. 5 may be described above, and for the sake of brevity, a further description of these elements is omitted.

As depicted in FIG. 5, due to the relative movement of support sleeve 820 and collet 840, support sleeve 820 may no longer be aligned with the distal end 842 of collet 840, and no longer prop open distal end 842. This relative positioning may automatically cause distal end 842 of collet 840 to radially collapse and radially decrease in size. Additionally, responsive to a diameter across distal end 842 decreasing in size, threads 846 positioned on the outer diameter of distal end 842 may clear the threads on the inner diameter of the mandrel 930 of the frac plug. To this end, when support sleeve 820 is no longer aligned with distal end 842, support sleeve 820 may no longer prop open the inner diameter of distal end 842, which will allow a diameter across distal end 842 to collapse.

Figure 6:
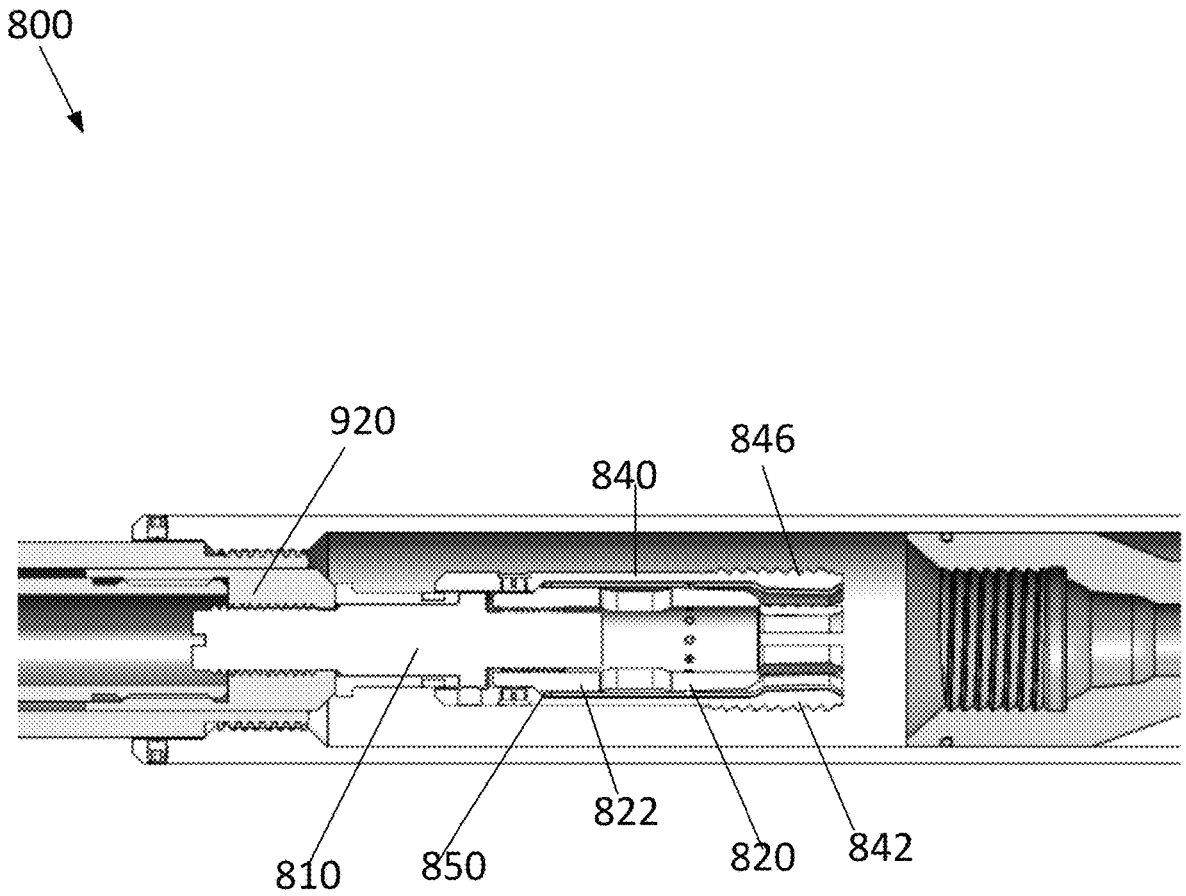
FIG. 6 depicts a system utilizing an adaptor kit to couple a setting tool with a frac plug after a setting rod is pulled out of the hole, according to an embodiment.

FIG. 6 depicts a system 800 utilizing an adaptor kit to couple a setting tool with a frac plug after a setting rod 920 is being pulled out of the hole, according to an embodiment. Elements depicted in FIG. 6 may be described above, and for the sake of brevity, a further description of these elements is omitted.

As depicted in FIG. 6, responsive to setting rod 920 being pulled out of the hole, setting rod 920 may correspondingly move adaptor 810 and support sleeve 820. Furthermore, support sleeve 820 may translate forces to pull collet 840 out of the hole via profile 822 on the outer diameter of support sleeve 840 contacting ledge 850 on the inner diameter of collet 840.

Furthermore, because distal end 842 is misaligned within support sleeve 820, threads 842 may radially clear the corresponding threads on the inner diameter of mandrel 930.

Figure 7:
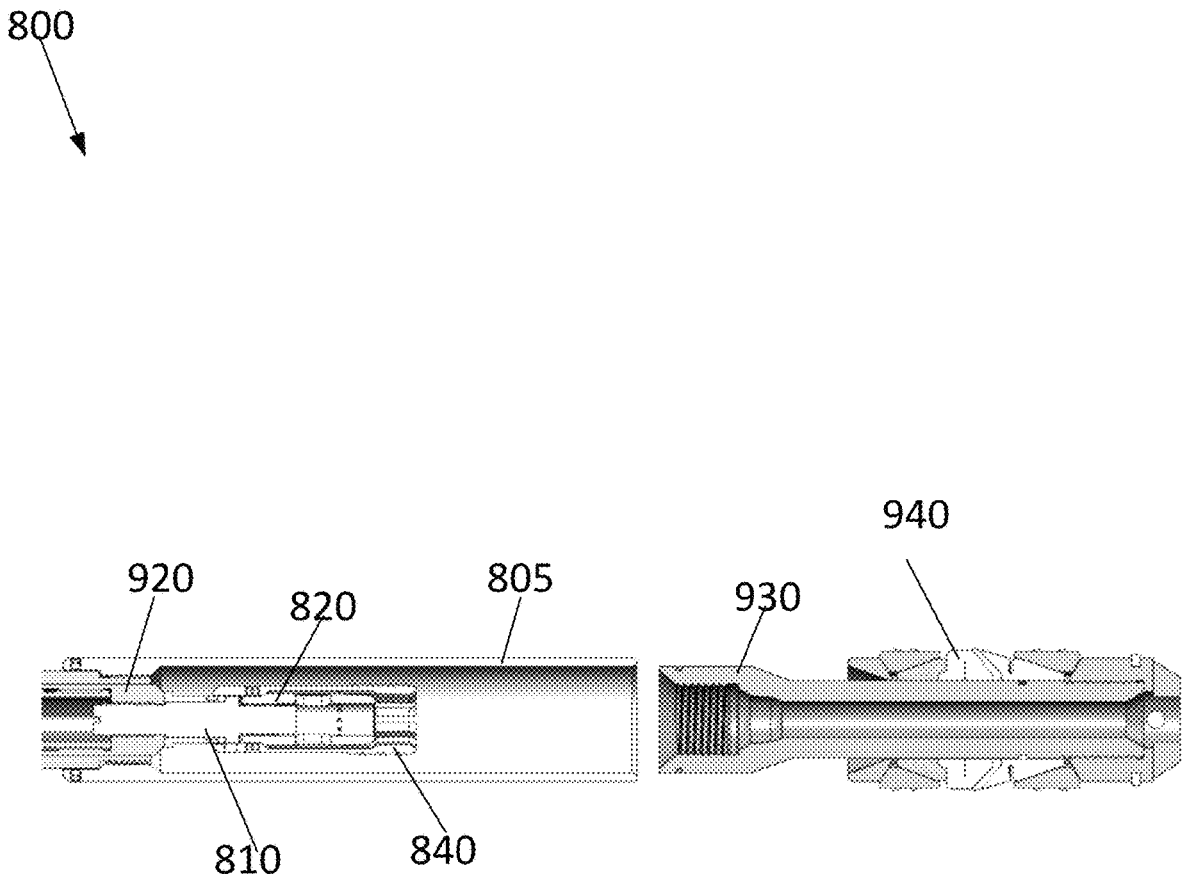
FIG. 7 depicts a system utilizing an adaptor kit to couple a setting tool with a frac plug after a setting rod is pulled out of the hole, according to an embodiment.

FIG. 7 depicts a system 800 utilizing an adaptor kit to couple a setting tool with a frac plug after a setting rod 920 is being pulled out of the hole, according to an embodiment. Elements depicted in FIG. 7 may be described above, and for the sake of brevity, a further description of these elements is omitted.

As depicted in FIG. 7, while setting sleeve 805, setting rod 920, adaptor 810, support sleeve 820, and collet 840 are pulled out of the hole, mandrel 930 and frac plug 940 may remain downhole.

Figure 8:
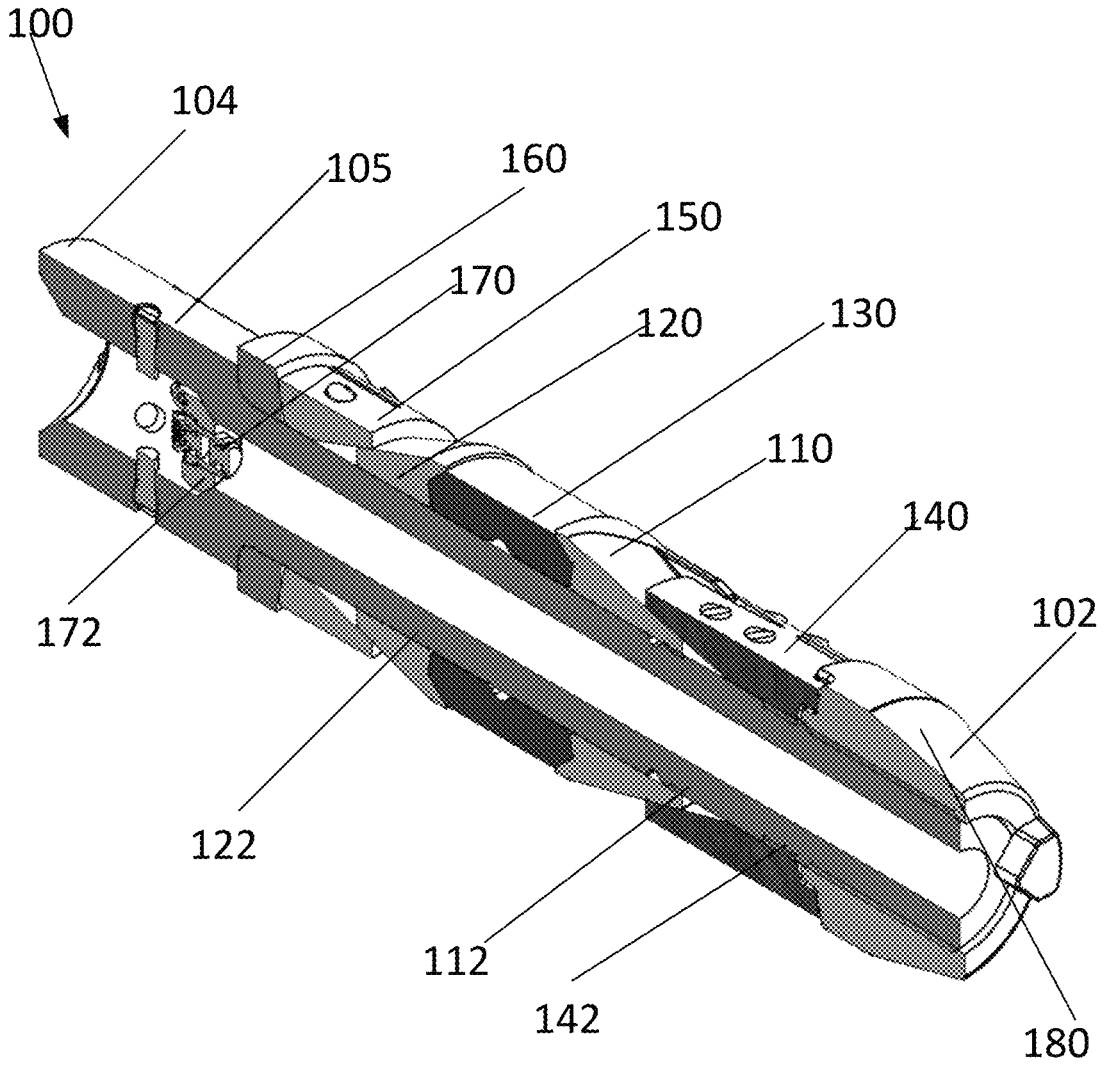
FIG. 8 depicts a downhole tool, according to an embodiment.

FIG. 8 depicts a downhole tool 100, according to an embodiment. The downhole tool 100 may be a frac plug, which may be configured to isolate a stage in a cased hole after cementing. Downhole tool 100 may enable perforating and treating each stage optimally and selectively, wherein downhole tool 100 is pumped down to a desired depth, and set, and the zone above may be perforated. In embodiments, downhole tool 100 may be a frac plug that is formed of any material, or a combination of materials. The downhole tool 100 may include a mandrel 105, lower cone 110, upper cone 120, packing element 130, lower slips 140, upper slips 150, load ring 160, flapper 172, and cap 180.

Lower cone 110 may be positioned between packing element 130 and lower slips 140. Lower cone 110 may be configured to engage with lower slips 140 to radially expand or break the lower slips 140. In embodiments, lower cone 110 may be coupled to the mandrel 105 via threads 112 or any other coupling method. Threads 112 may be positioned on an outer circumference of mandrel 105, and may allow lower cone 110 to be coupled to mandrel 105. The coupling of lower cone 110 and mandrel 105 may limit the longitudinal movement of lower cone 110 while downhole tool 100 is being run in the hole. Specifically, threads 112 may not allow lower cone 110 to move to interface with lower slips 140 prematurely before an operation is used to activate downhole tool 100. As such, incidental pressure changes from fluid flowing around lower cone 110 while downhole tool 100 is being pumped downhole may not be sufficient to substantially move lower cone 110 to set lower slips 140. Responsive to operating to set downhole tool 100, such as operating a setting tool, the forces applied against threads 112 may be sufficient enough to break the coupling point, which may allow lower cone 110 to move downhole and slide under lower slips 140, which may radially expand lower slips 140.

Upper cone 120 may be positioned between the upper slips 150 and packing element 130. Upper cone 120 may be configured to engage with upper slips 150. When upper cone 120 engages with upper slips 150, upper slips 150 may radially expand. In embodiments, the upper cone may be coupled to the mandrel 105 via threads 112 or any coupling mechanism, such as pins. Threads 112 may allow upper cone 120 to be coupled to mandrel 105, which may limit the longitudinal movement of upper cone 120 while downhole tool 100 is being run in the hole. In other embodiments, the threads 112 can be any coupling point including a pin that couples the upper slips 150 to the cone 120 and mandrel 122. Specifically, coupling point 122 may not allow upper cone 120 to move to interface with upper slips 150 or packing element 130 prematurely before an operation is used to activate downhole tool 100. As such, incidental pressure changes from fluid flowing around upper cone 120 while downhole tool 100 is being pumped downhole may not be sufficient to substantially move upper cone 120 to set upper slips 120. Responsive to performing an operation to set downhole tool 100, such as operating the setting tool, the forces applied against coupling point 122 may be sufficient to break the coupling point, which may allow upper cone 120 to move. Furthermore, upper cone 120 may be configured to allow upper slips 150 to slide over upper cone 120 to radially expand upper slips 150.

Packing element 130 may be an elastomeric packing element that is configured to radially expand and seal across the annulus based on a pressure differential. An elasticity of packing element 130 may be based upon the cross-sectional thickness of the sealing element, which may be controlled based on the profiles of the inner diameter and outer diameter of packing element 130. The outer diameter of packing element 130 may have a concave curvature, which increases the thickness of sealing element 150 towards the ends of the longitudinal axis of packing element 130. By varying the thickness of the packing element 130, cross-sectional areas of the packing element 130 may be varied. This may change a pressure differential applied to the packing element 130 at different cross-sectional areas. Accordingly, as fluid is pumped within the annulus between the outer surface of the packer and casing, the curvature of the outer surface may control or create a Bernoulli Effect and the pressure differential across the Packing element 130 at different locations. As such, packing element 130 may not deploy prematurely. In embodiments, packing element 130 may be positioned between lower cone 110 and upper cone 120 and may be configured to radially expand responsive to a distance between lower cone 110 and upper cone 120 decreasing, which may occur after threads 112 and 142 are broken.

Lower slips 140 and upper slips 150 may be configured to radially move outward and expand across an annulus to secure mandrel 105 to a casing, wherein the annulus is positioned between an outer diameter of mandrel 105 and the casing. Responsive to moving slips 140, 150 across the annulus, slips 140, 150 may grip the inner diameter of the casing.

More specifically, lower slips 140 may be positioned between lower cone 110 and cap 180. Lower slips 140 may be configured to radially expand or break responsive to lower cone 110 moving below lower slips 140. Responsive to performing an operation to set downhole tool 100, such as operating the setting tool, the forces applied against threads 142 may be sufficient enough to break the threads 142, which may allow lower slips 140 to move. In other embodiments, the lower slips 140 may expand radially lower cone 110 slides under lower slip 140.

Upper slips 150 may be positioned between upper cone 120 and load ring 160. Upper slips 150 may be configured to radially expand responsive to upper cone 120 moving below upper slips 150. Responsive to performing an operation to set downhole tool 100, such as operating the setting tool, the forces applied may allow upper cone 120 to move, and subsequently move upper slips 150.

Load ring 160 may be an upper bound of the elements positioned on the outer diameter of the mandrel 105. Load ring 160 may operate as a no-go, stopper, etc. configured to limit the movement, towards a proximal end of the frac plug, of the other elements on the outer mandrel 105. A load ring may be also used to transfer the force from the setting tool during operation to the other components of the frac plug, allowing the frac plug to engage the casing ID and set it inside.

Cap 180 may be positioned on a distal end 102 of downhole tool 100. Cap 180 may be positioned adjacent to lower slips 140, and limit the rotational movement and linear movement of lower slips 140. The cap may include a passageway that extends through the inner diameter of the cap from a proximal end to a distal end of the cap 180. The passageway may allow fluid to flow through the inner diameter of the frac plug.

Flapper 172 may be configured to allow the flow of fluid in one direction. The one direction may usually be from the distal end of the well to the proximal end of the well while restricting the flow of fluid in the opposite direction. Flapper 172 may be made of millable material such as plastic, fiber, brass, or dissolvable material. In further embodiments, Flapper 172 may be configured to have an open and closed position responsive to flowing fluid from a distal end of tool 100 towards a proximal end of tool 100 while the weak point assembly 170 is intact. In embodiments, flapper 172 may be mounted across an inner diameter of downhole tool 100 or on mandrel 105. Flapper 172 may include weak point assembly 170, wherein weak point assembly 170 may be configured to assist in controlling the flow of fluid between a positioned above flapper 172 and a location below flapper 172.

Weak point assembly 170 may include a housing, disc, and shear pin or shear disc, wherein weak point assembly 170 may be any geometric shape. The housing may be configured to be positioned within a passageway in weak point assembly 170. The housing may be a removable component within weak point assembly 170 or may be an integral component. The housing may have a hollow inner diameter extending from the first face of the housing to the second face of the housing. In embodiments, fluid may be configured to flow through the hollow inner diameter responsive to a disc being removed from the housing. The housing may be configured to temporarily secure the disc and shear pin. The disc may be an object that is configured to be embedded within the housing when weak point assembly 170 is intact. The disc may be configured to move downhole etc. responsive to a pressure differential applied to a shear pin being greater than a pressure threshold. The shear pin may be a device inserted into the housing and extends through and across the disc. In embodiments, the shear pin may be exposed to shearing forces via pressure applied on the disc, wherein when the shearing forces are greater than the pressure rating of the shear pin then the shear pin may break. Responsive to the breaking, the disc may move from a position within the housing to a position outside of the housing.

In embodiments, weak point assembly 170 may be used in a fracturing procedure utilizing fracturing fluid that fractures formation after the well is cemented. In embodiments, a fracturing procedure may be any procedure associated with a well after it is cemented and before the well is abandoned, such as a gun misfire, premature setting of the frac plug, formation screen out above the plug, or any other operation that utilize a frac plug that may include or cause an increase in the pressure above the weak point value within the frac plug if needed.

FIG. 9 depicts a perspective view of lower cone 110 and lower slips 140, according to an embodiment. Elements depicted in FIG. 9 may be described above, and for the sake of brevity, a further description of these elements may be omitted.

Figure 10:
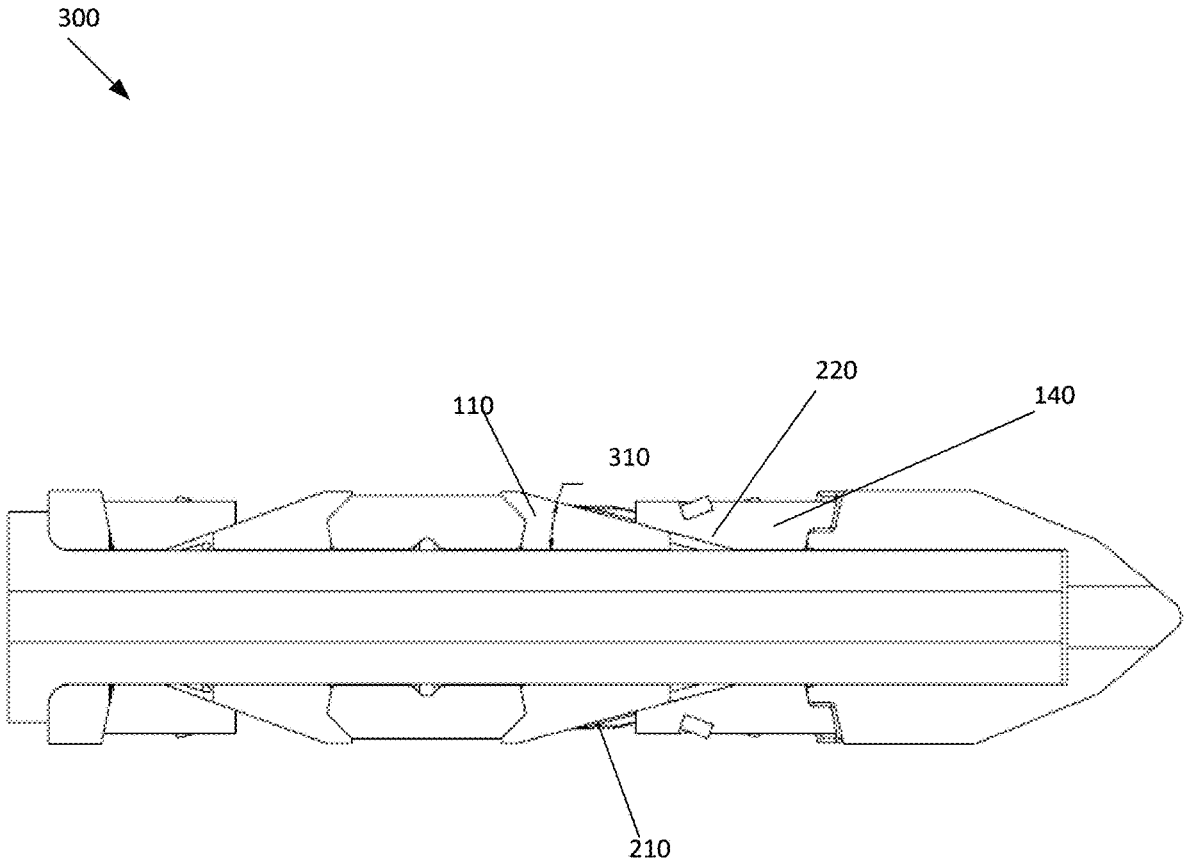
FIG. 10 depicts a first cross-sectional view of the downhole tool, according to an embodiment.

As depicted in FIG. 10, lower cone 110 may include a ramp surface 210 and fins 212. Ramp surface 210 may be a sloped outer surface of lower cone 110, and be positioned a pair of fins 212. Ramp surface 210 may be sloped towards a central axis of the downhole tool 100. The slope of ramp surface 210 may cause the proximal end of lower cone 110 to be thicker than the distal end of lower cone 110, wherein the slope of ramp surface 210 may be a lower cone ramp angle being between five and thirty degrees. Ramp surface 210 may have a substantially wider length than fins 212.

Fins 212 may be equally spaced around the perimeter of lower cone 110. Fins 212 may be configured to slide within and below upper notch 224 without touching the inner surface of webbing 228. Fins 212 may have a cone bevel angle that is sloped towards the central axis of the downhole tool 100. The slope of the cone bevel angle may cause the proximal end of fin 212 to be thicker than the distal end of fin 212. In embodiments, the cone bevel angle may be less than or equal to the lower cone ramp angle. In other embodiments, the cone bevel angle may be slightly larger than the lower cone ramp angle, such as ten percent larger.

Lower slips 140 may be configured to radially expand based on forces applied by ramp surface 210 interfacing with an inner surface of wedges 220 expand wedges 220. Wedges 220 may be formed between webbings 228, wherein webbings 228 are formed along a longitudinal axis of lower slips 140 between an upper notch 224 and lower notch 226. Responsive to lower slips 140 sliding downward, ramp surface 210 may break lower slips 140 into pairs of wedges 220 due to radial hoop stresses. For example, if you have six wedges 220, the wedges 220 may break into three pairs of wedges 220. In embodiments, single wedges 220 may not be partitioned from all other wedges because fins 212 may not interact directly with an inner surface of webbing 228. This reduces shearing forces being applied to the wedges 220 after a pair of wedges 220 has been disengaged from the other wedges 220

In embodiments, webbings 228 may include a slip inner cut angle, which may be less than or equal to the lower cone ramp angle, and the slip inner cut angle may be substantially equal to the cone bevel angle. In other embodiments, the slip inner cut angle may be slightly larger than the lower cone ramp angle, such as ten percent larger. The slope of the slip inner cut angle may cause a proximal end webbing 228 to be thinner than a distal end of webbing 228.

In embodiments, the slip inner cut angle, the cone bevel angle, and the lower cone ramp angle may all be non-zero angles that extend in the same direction.

FIG. 10 depicts a first cross-sectional view 300 of the downhole tool 100, according to an embodiment. More specifically, the cross-sectional view is aligned in a plane where ramp surface 210 intersects with an inner surface of wedge 220. Elements depicted in FIG. 3 may be described above, and for the sake of brevity, a further description of these elements may be omitted.

As depicted in FIG. 10, the wedge angle of the lower slip 140 may be substantially similar to the lower cone ramp angle 310 of the ramp surface 210. This enables ramp surface 210 to slide under wedge 220 to radially expand lower slip 140.

Figure 11:
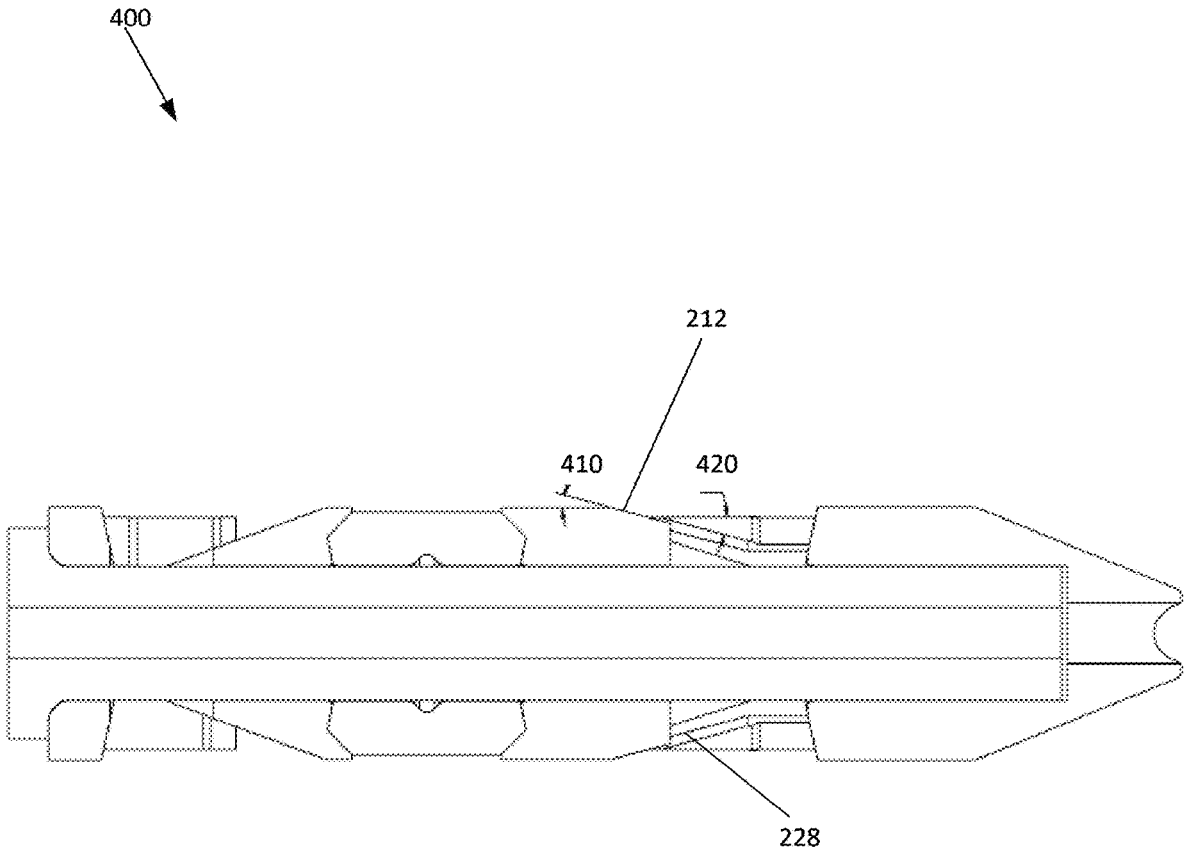
FIG. 11 depicts a second cross-sectional view of the downhole tool, according to an embodiment.

FIG. 11 depicts a second cross-sectional view 400 of downhole tool 100, according to an embodiment. More specifically, the cross-sectional view is aligned in a plane where fin 212 intersects with an inner surface of webbing 228. Elements depicted in FIG. 11 may be described above, and for the sake of brevity, a further description of these elements may be omitted.

As depicted in FIG. 11, the cone bevel angle 410 of fin 212 may be substantially similar to that of the slip inner cut angle 420 associated with the webbing 228. In embodiments, an outer surface of fin 212 may be offset from the inner surface of webbing 228, at a location away from the outer diameter of mandrel 105. Due to the inner cut angle 420 and the cone bevel angle 410 being substantially similar, even as ramp surface 210 interacts with the inner surface of the wedges 220 to radially expand lower slips 140, fin 212 nor any other element of cone 110 may interact and touch the inner surface of webbing 228. This may enable the wedges 228 to not break due to the fins 212 interacting with the webbing 228. However, wedges 228 may break due to hoop stresses caused by wedges 228 expanding as they move over ramp 210 of the cone 110.

Additionally, as depicted in FIG. 11, before being deployed a distal end 420 of fin 212 may be positioned under a proximal end 430 of webbing 228. This may limit the ability of fin 212 to accidentally shear an edge of webbing 228. Further, even if there was inadvertent contact between fin 212 and the inner surface of webbing 228, fin 212 would assist in radially expanding webbing 228 rather than shearing webbing 228.

Figure 12:
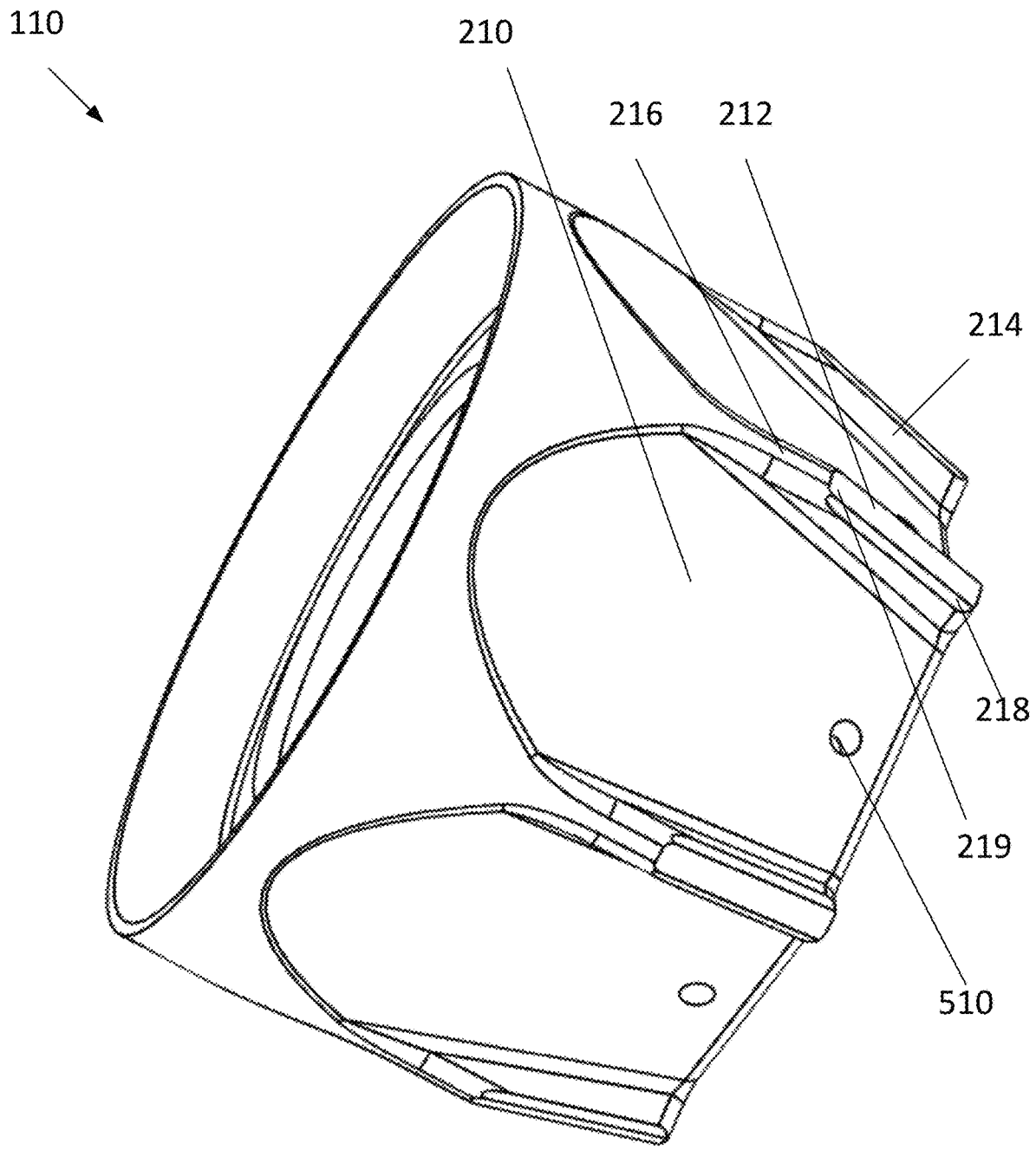
FIG. 12 depicts a lower cone, according to an embodiment.

Also, in embodiments, the outer surface 440 of webbing 228 may extend in a radial plane that is perpendicular to the central downhole tool 100, and inner cut angle 450 associated with webbing 228 may continually extend until the inner surface of webbing 228 and the outer surface 440 of webbing 228 intersect. Alternatively, the inner cut angle 450 may terminate in a right angle at a plane 410 orthogonal to the central axis of downhole tool 100, which occurs before the natural intersection of the inner cut angle 450 and the outer surface 450 of webbing 228. For example, FIG. 12 depicts a lower cone 110, according to an embodiment. Elements depicted in FIG. 12 may be described above, and for the sake of brevity, a further description of these elements may be omitted.

As depicted in FIG. 12, ramp surface 210 and the outer surface of fins 212 may have a similar angle. Furthermore, ramp surface 210 and the outer surface of fins 212 may be radially offset from each other, wherein the outer surface of ramp 210 is radially positioned further away from a central axis of lower cone 110 than the outer surface of fins 212.

As further depicted in FIG. 12, cone 110 may include a coupling orifice 510. The coupling orifice 510 may be configured to receive a pin, threads, or any other coupling mechanism. The coupling mechanism may be configured to be inserted through the coupling orifice 510, which may couple cone 110 with slips 140 and the mandrel. In embodiments, coupling orifice 510 may be positioned on a ramp surface 210 of cone 110, at a location proximate to a distal end of cone 110.

Fins 212 may also include planer sidewalls 214 that extend in parallel to each other. Fins 212 may extend radially away from ramp surface 210. Because planer sidewalls 214 extend in parallel to each other a width across an entire body, or parts of the body, of fins 214 may be substantially equal. Additionally, because the tapering of fins and ramp surface 210 is equal, the upper surface of the distal end 218 of planer sidewalls 214 and ramp surface 210 may have the same radial offset from the upper surface of proximal end 219 of planer sidewalls 214 and ramp surface 210.

In embodiments, fins 212 may also include a tapered proximal end 216 that gradually increases the height of fins 212, wherein tapered proximal ends 216 are positioned between the proximal end of 219 of planer sidewalls 214 and a proximal end of cone 110. Furthermore, planer sidewalls 214 may be positioned between tapered proximal ends 214 and the distal end of cone 110.

Figure 13:
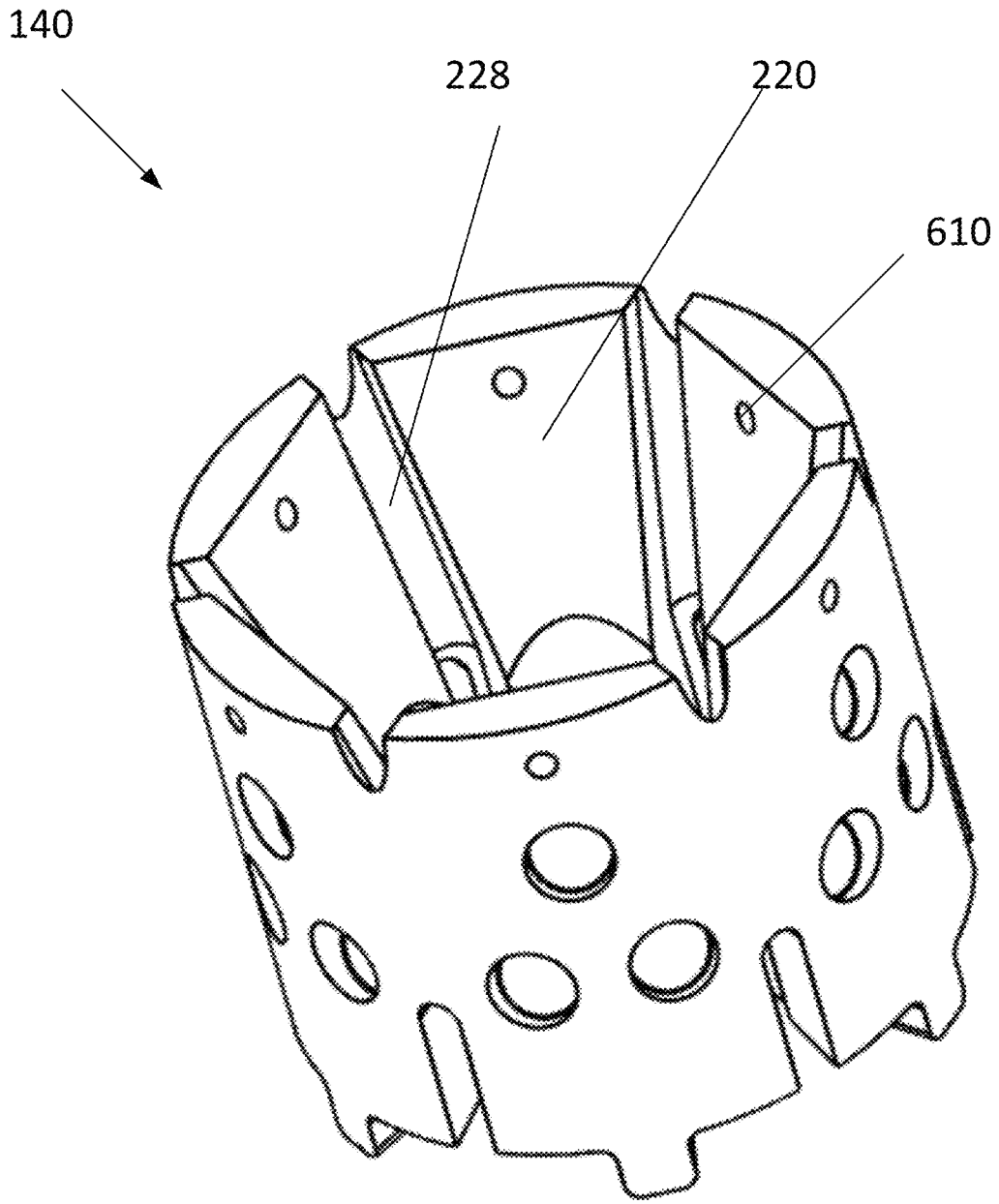
FIG. 13 depicts lower slips, according to an embodiment.

FIG. 13 depicts lower slips 140, according to an embodiment. Elements depicted in FIG. 14 may be described above, and for the sake of brevity, a further description of these elements may be omitted.

As depicted in FIG. 13, an inner cut angle of the inner surface of webbing 228 may be similar to that of the inner surfaces of wedges 220. As such, a radial offset between the inner surface of webbing and the inner surfaces of wedges 220 may remain constant, which may enable the outer surface of fins 212 to not directly interact or contact the inner cut angle of webbing 228. By having fins 212 not contact the inner surfaces of lower slips 140, the wedges 220 may not shear and may eventually break off into pairs of wedges 220 that are still connected by webbing 228. To this end, when lower slips 140 have radially expanded and are gripping the inner diameter of the casing, pairs of wedges 220 may still be directly connected.

As further depicted in FIG. 13, slips 140 may include a coupling orifice 610. Coupling orifice 610 may be configured to receive a pin, threads, or any other coupling mechanism. The coupling mechanism may be configured to be inserted through the coupling orifice 610 and cone, which may couple cone 110 and slips 140 with the mandrel. In embodiments, coupling orifice 610 may be positioned through wedges 220, at a location proximate to a proximal end of slips 140. To this end, coupling mechanisms in the same radial plane may be utilized to couple slips 140, cone 110, and the mandrel.

Figure 14:
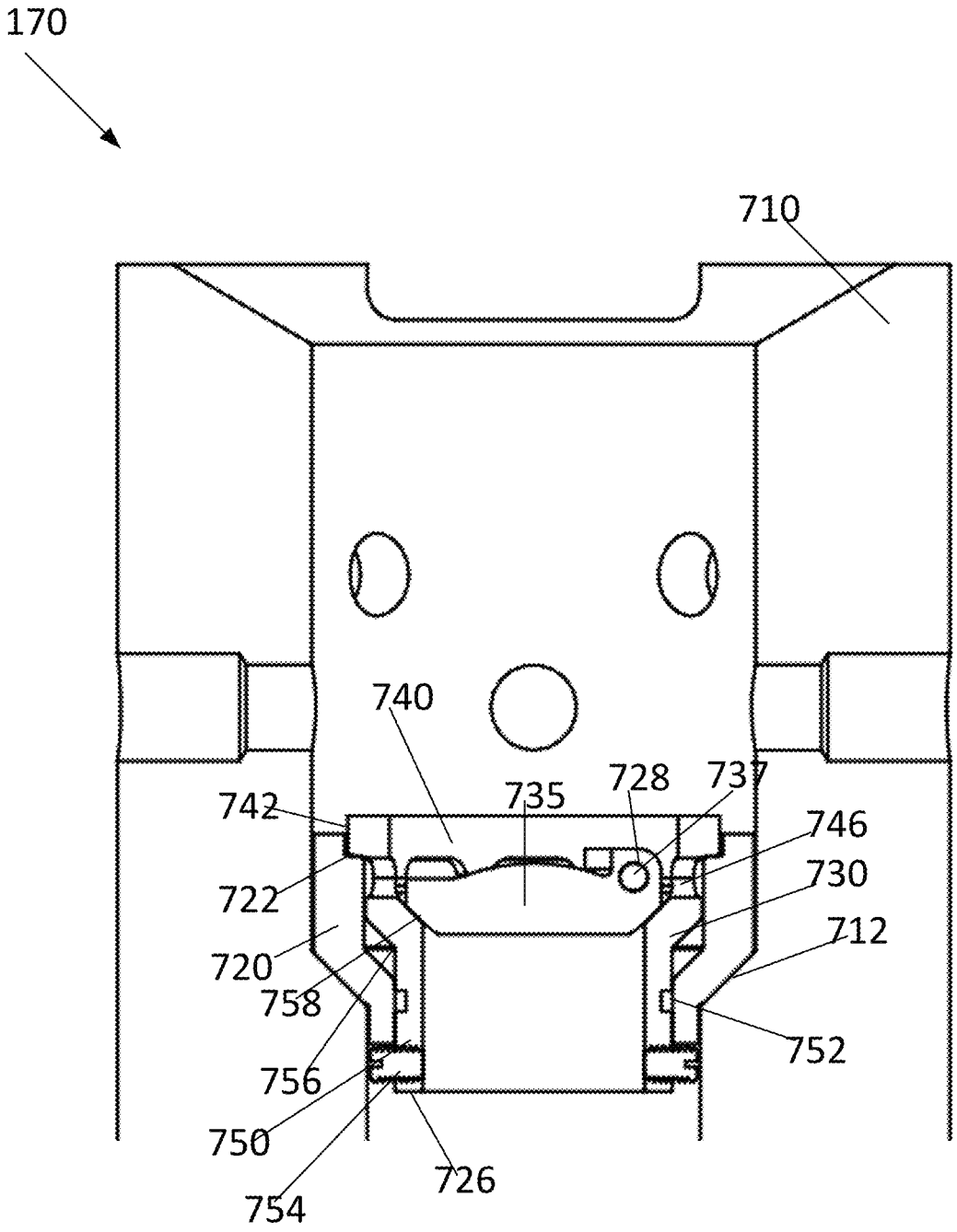
FIG. 14 depicts one embodiment of a weak point assembly, which may be utilized within the downhole tool.

FIG. 14 depicts one embodiment of a weak point assembly 170, which may be utilized within frac plug 940. Weak point assembly 170 may be configured to be positioned on a mandrel 710 and may include insert 720 and housing 730.

Mandrel 710 may be a shaft, cylindrical, rod, etc. that is configured to form a body of downhole tool 700. In embodiments, mandrel 710 may be the same as mandrel 930. Mandrel 710 may include a profile 712 that reduces the inner diameter of mandrel 710 which limits the movement of insert 720 in the first direction. Profile 712 may be a ledge that is perpendicular to a central axis of the downhole tool 100 or may be a tapered sidewall that gradually and incrementally decreases the inner diameter of mandrel 710. In other embodiments, there may be no need to have profile 712.

Insert 720 may be a tool formed of composite material, or any desired material. Insert 720 may be configured to be mounted on an inner diameter of mandrel 710 of downhole tool 700. Insert 720 may include ledge 722, sloped sidewall 724, distal end 726, and pin slots 128. Insert 720 may be threaded, glued pinned, or fixed to mandrel 710 using any other method. In other embodiments, insert 720 may be just part of the body 710 or may be removed completely and may be replaced by a profile on body 710.

Ledge 722 may decrease an inner diameter across insert 720, which may be configured to act as a stopper, no-go, etc. to restrict the movement of an upper portion of housing 730 in a first direction, wherein the first direction may be downhole. More specifically, ledge 722 may be configured to receive a projection 742 of upper portion 740 of the housing 730. Responsive to positioning projection 742 of upper portion 740 on ledge 722, movement of housing 730 in the first direction may be restricted when upper portion 740 and lower portion 750 are coupled together. However, when upper portion 740 and lower portion 750 are decoupled, ledge 722 may not restrict the movement of lower portion 750 in the first direction.

Sloped sidewall 724 may be configured to gradually decrease the inner diameter of the insert 720. Sloped sidewall 724 may be configured to receive lower portion 750 of housing 730 to restrict the movement of lower portion 750 in the first direction responsive to decoupling upper portion 740 and lower portion 750. In embodiments, an angle of the sloped sidewall may correspond to the tapered sidewall of mandrel 710. Furthermore, a seal may be formed between an outer diameter of lower portion 750 and an inner diameter of insert 720 when lower portion 750 and upper portion 740 are de-coupled.

The distal end 726 of the insert 720 may project away from the inner diameter of the mandrel 710 to create a lower shelf. Distal end 726 may be configured to interface with elements locking outcrops 754 of lower portion 750 to limit the movement of lower portion 750 in a second direction. In certain embodiments, tool 700 may not include an insert 720 and housing 730 may be directly mounted on mandrel 710, wherein mandrel 710 may have a similar inner profile as that described above.

Pin slots 728 may be holes, slots, indentations, etc. positioned through inserts that are configured to selectively receive flapper pin 737. Specifically, pin slots 728 may have a first end that is positioned on the proximal end of insert 720 and extend towards a distal end of insert 720. Pin slots 728 may extend in a linear path with a larger length than that of flapper pin 737, which may allow flapper pin 737 to be free-floating within pin slots 728. The proximal end of pin slots 728 may be configured to be contained between the upper portion 740 and lower portion 750 of housing 730 when upper portion 740 and lower portion 750 are coupled together. After flapper pin 737 is disengaged from pin slots 728 it may be unlikely that flapper pin 737 can reengage with pin slots 728 down well.

Housing 730 may be formed of brass, composite, aluminum, cast iron, or any other material that can dissolve over time due well fluid and temperature. Housing 730 may be configured to be positioned within insert 720 when run in a hole, wherein elements of housing 730 may all be coupled together when run in a hole. The housing 730 may include a flapper 735, upper portion 740, and lower portion 750. In other embodiments, the flapper 735 and flapper pin 737 may be replaced by a disc or any geometrical shape.

Flapper 735 may be a rotatable disc formed of brass, composite, aluminum, cast iron, or any other material that can dissolve over time due well fluid and temperature. Flapper 735 may be configured to rotate from a position blocking an inner diameter of the tool 700 to a position allowing fluid to flow around flapper 735. When flapper 735 extends across an annulus within the tool, flapper 735 may be configured to be positioned on a flapper seat 158 within the lower portion of housing 730. When flapper 735 is positioned on flapper seat 158, whether upper portion 740 and lower portion 750 are coupled or decoupled from each other, a first area on the first side of flapper 735 may be isolated from a second area on the second side of flapper 735. Accordingly, flapper 735, lower portion 750, and insert 720 may extend across an inner diameter of mandrel 710 to form a seal across a plane through mandrel 710 to isolate the first area from the second area. However, if flapper 735 is rotated to not extend across the annulus within tool 700 and/or upper portion 740 is not positioned within insert 720, then the first area and second area may not be isolated from each other. Flapper 735 may be a free floating component that is mounted inside the housing 730 via a flapper pin 737 and insert 720. Flapper 735 may be configured to apply forces when pressure or forces are applied to flapper 735 from above against stress points 746 within housing 130 to separate upper portion 740 and lower portion 750 of housing.

Flapper pin 737 may be a free floating, which enables flapper 735 to move along a linear axis confined by pin slots 728. Flapper pin 737 is configured to extend across an entirety of the diameter of the housing and has ends that are configured to be inserted into pin slots 728. When flapper pin 737 is inserted into the pin slots 728, flapper 735 may be couple housing 730 and insert 720. In embodiments, flapper pin 737 may be an integral portion of flapper 735 or may be removably coupled to flapper 735, such that flapper pin 737 may slide out of flapper 735.

Upper portion 740 of housing 730 may be configured to be selectively coupled to lower portion 750 of housing 730 based on a pressure applied across housing 730 and a direction of fluid flowing within tool 700, wherein both upper portion 740 and lower portion 750 are positioned within an inner diameter of mandrel 710 when run in hole. Upper portion 140 may include projection 742 and stress points 746. In other embodiments, upper portion 740 and lower portion 750 may be two elements connected via stress points 746 which can be a shear screw.

Projection 742 may be positioned on the proximal end of upper portion 740 and project away from a central axis of housing 730 to increase the outer diameter of upper portion 740. Projection 742 may be configured to slide onto and sit on ledge 722. Responsive to positioning projection 742 on ledge 722, movement of upper portion 740 in the first direction may be limited.

Stress points 746 may be positioned between upper portion 740 and lower portion 750 of housing 730. Stress points 746 may be weak points where upper portion 740 becomes disconnected from lower portion 750, wherein stress points 746 extend in parallel to a central axis of mandrel 710, wherein stress points 746 are not coupled to mandrel 710, insert 720 or flapper 735. In embodiments, stress points 746 may be configured to receive a force from flapper 735 against flapper seat 758 responsive to moving the free-floating flapper 735 to be positioned on flapper seat 758. More specifically, when fluid is flowing through the inner diameter of tool 700, flapper 735 may receive forces created by the flowing fluid/pressure. This may allow flapper 735 to sit on the lower portion 750 of the housing 730, and cause flapper 735 to apply pressure against the stress points 746. When flapper 735 applies a pressure greater than a stress threshold of stress points 746, stress points 746 may break causing upper portion 740 and lower portion 750 to become detached and separated. Then, lower portion 750 of housing may move in the first direction towards the distal end of housing 730 with the flapper 735 and flapper pin 737.

Lower portion 750 of housing 730 may be configured to be selectively coupled to upper portion 740 of housing 730. Lower portion 750 may include seal 752, locking outcrops 754, and tapered sidewall 756. Seal 752 may be configured to be positioned between an outer diameter of the lower portion 750 and an inner diameter of inset 720. Seal 752 may not allow communication through a gap between insert 720 and housing 730 when the lower portion 750 is still connected to the upper portion 750 of housing 730, and when flapper 735 is positioned on flapper seat 758. Locking outcrops 754 may be positioned on the distal end of lower portion 750 below the distal end 726 of insert 720.

Locking outcrops 754 may increase the outer diameter of the lower portion 750 such that the diameter of locking outcrops 754 is larger than that of distal end 726. Due to locking outcrops 754 being larger than the outer diameter of the distal end 726 and the internal diameter of the lower end of insert 720, locking outcrops 754 may restrict the movement of lower portion 750 in a second direction relative to insert 720, wherein the second direction is an opposite position from the first direction. This may assist in disengaging the upper portion 740, flapper 735, and flapper pin 737 from the lower portion 740 when there is a flow back through tool 700. Further, by restricting lower portion 750 from moving in the second direction using locking outcrops 754 and the first direction using ledge 722, the lower portion 750 can be milled with the frac plug as an integral piece. Hence facilitating milling operations if needed.

Tapered sidewall 756 may be a slanted sidewall that is configured to be positioned on the slanted sidewall 724 of insert 720 after lower portion 750 is sheared from upper portion 740.

Flapper seat 758 may be positioned between stress points 746 and locking outcrops 754. Flapper seat 758 may be configured to reduce the inner diameter across lower portion 750, such that flapper 735 may be positioned on flapper seat 758. Responsive to flapper 735 receiving pressure above the flapper 735 in the first direction, flapper 735 may translate these forces to lower portion 730 through flapper seat 758, which may shear stress points 746.

In embodiments, upper portion 740 and lower portion 750 of housing may be coupled together via stress points 746 within the inner diameter of mandrel 110. As such, upper portion 740, lower portion 750, and stress points 746 may be positioned within the same vertical plane extending through the inner diameter of mandrel 710. This may enable upper portion 740 and lower portion 750 to be sheared along a plane that extends in parallel to a central axis of the mandrel 710. In other embodiments, the upper portion 740 and lower portion 730 can be two separate pieces coupled together with stress point 745

After the shearing of upper portion 740 from lower portion 730, flapper 735 may still be encompassed by upper portion 740 and lower portion 750 until fluid is flowed in an opposite direction that is used to shear upper portion 740 from lower portion 750.

In embodiments, insert 720 and housing 730 may be configured to run downhole in front of adaptor 810. This may allow for the wireline adaptor kit, frac plug, and an object that forms a seal across the frac plug to be run in a hole in a single run without the need to drop or position additional tools downhole.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A downhole tool comprising:

a conveyed object having a mandrel with an inner diameter profile, an inner diameter of the mandrel having first threads;

a collet having a proximal end and a segmented distal end, the outer diameter of the collet having second threads, the distal end defining an outer diameter profile configured to engage the inner diameter profile of the mandrel in a radially expanded condition and to disengage from the inner diameter profile in a radially collapsed condition, and a cavity between the proximal end and the distal end, the cavity including a ledge;

a support sleeve extending within the collet and having a projection on an outer diameter thereof, the projection having an outer diameter greater than an adjacent outer diameter of the support sleeve;

wherein, in a run-in position, the projection is aligned with the distal end of the collet and props the distal end radially outward into the expanded condition such that the second threads threadably engage the first threads and supports the conveyed object; and wherein, the conveyed object is configured to be transitioned into a release position by moving the support sleeve relative to the collet, wherein the projection is received in the cavity and positioned adjacent to the ledge such that the distal end of the collet is free to radially collapse into the collapsed condition with an outer diameter less than the inner diameter profile of the mandrel, and further configured such that axial movement of the support sleeve in the release position causes the projection to bear against the ledge to pull the collet uphole while the conveyed object remains downhole.

2. The downhole tool of claim 1, wherein the conveyed object is a frac plug.

3. The downhole tool of claim 1, wherein the collet has a propped open outer diameter that is positioned within an inner diameter of a mandrel of the conveyed object when run in hole.

4. The downhole tool of claim 1, further comprising:

an adaptor configured to couple a setting rod with the support sleeve.

5. The downhole tool of claim 4, wherein the adaptor is part of the support sleeve as a unified piece.

6. The downhole tool of claim 4, wherein the adaptor is coupled to the support sleeve via threads.

7. The downhole tool of claim 4, further comprising:

a temporary coupling mechanism that restricts movement between the adaptor and collet until activated.

8. The downhole tool of claim 7, wherein the temporary coupling mechanism is a shear screw.

9. The downhole tool of claim 7, wherein the support sleeve is configured to move in a second direction along the longitudinal axis relative to the collet to misalign the distal end of the collet and the projection of the support sleeve to release the conveyed object.

10. The downhole tool of claim 9, wherein a diameter across the distal end of the collet is configured to decrease in size to misaligning the distal end of the collet and the support sleeve.

11. The downhole tool of claim 9, wherein after misaligning the distal end of the collet and the support sleeve the projection on the outer diameter of the support sleeve is positioned within a recession on the inner diameter of the collet, the recession having a bigger inner diameter than the distal end of the collet.

12. The downhole tool of claim 11, wherein the recession includes a ledge, and the projection on the outer diameter of the support sleeve is configured to be positioned adjacent to the ledge of a cavity when the collet is pulled out of the hole, the recession having a larger inner diameter than the ledge.

13. The downhole tool of claim 1, wherein when the distal end of the collet is configured to move radially inward due to the misalignment of the distal end of the collet and the projection, an outer diameter of the collet becomes smaller than an inner diameter of a mandrel of the conveyed object.

14. The downhole tool of claim 13, wherein the temporary coupling mechanism is configured to activate after the conveyed object is set.

15. The downhole tool of claim 1, further comprising:

a setting rod, wherein the setting rod is coupled to an adaptor via threads, and the adaptor is coupled to the support sleeve via corresponding threads.

16. The downhole tool of claim 15, further comprising:

a setting sleeve that is configured to set the conveyed object, wherein the setting rod is configured to be positioned within the setting sleeve, and the setting rod is configured to have a stroke length to allow the setting sleeve to move in a first direction without the setting rod moving, and the setting sleeve and the setting rod move are configured to move in a second direction together, wherein the first direction is a downhole direction and the second direction is an uphole direction.

17. A method associated with a downhole tool, the method comprising:

conveying a conveyed object having a mandrel with an inner diameter profile, the inner diameter of the mandrel having first threads, into a wellbore;

providing a collet having a proximal end and a segmented distal end, the outer diameter of the collet having second threads, the distal end defining an outer diameter profile configured to engage the inner diameter profile of the mandrel in a radially expanded condition and to disengage from the inner diameter profile in a radially collapsed condition, and a cavity between the proximal end and the distal end, the cavity including a ledge;

providing a support sleeve extending within the collet and having a projection on an outer diameter thereof, the projection having an outer diameter greater than an adjacent outer diameter of the support sleeve;

positioning the support sleeve relative to the collet in a run-in position such that the projection aligns with the distal end of the collet and props the distal end radially outward into the expanded condition, whereby the second threads threadably engage the first threads and support the conveyed object;

moving the support sleeve relative to the collet to a release position after the conveyed object is set, such that the projection is received in the cavity and positioned adjacent the ledge, whereby the distal end of the collet is free to radially collapse into the collapsed condition with an outer diameter less than the inner diameter profile of the mandrel; and axially moving the support sleeve in the release position to cause the projection to bear against the ledge and pull the collet uphole while the conveyed object remains downhole.

18. The method of claim 17, further comprising:

retrieving the downhole tool and associated conveying means after activating the downhole tool, wherein the conveyed object remains downhole after the retrieving.

* * * * *